US005489216A

United States Patent [19]

Matsushita et al.

[11] Patent Number: 5,489,216

[45] Date of Patent: Feb. 6, 1996

[54] CARD EDGE CONNECTOR ASSEMBLY

[75] Inventors: Yasuo Matsushita; Mitsuhiro Fujitani, both of Yokkaichi, Japan

[73] Assignee: Sumitomo Wiring Systems, Ltd., Japan

[21] Appl. No.: 257,553

[22] Filed: Jun. 9, 1994

[30] Foreign Application Priority Data

Jun. 30, 1993 [JP] Japan ..... 5-188884

[51] Int. Cl.[6] ..... H01R 9/09

[52] U.S. Cl. ..... 439/260; 439/630

[58] Field of Search ..... 439/259, 260, 439/261, 263, 265–268, 629–632, 62

[56] References Cited

U.S. PATENT DOCUMENTS

| | | | |
|---|---|---|---|
| 3,526,869 | 9/1970 | Conrad et al. | 439/260 |
| 4,264,114 | 4/1981 | Chandler | 439/62 |
| 4,343,523 | 8/1982 | Cairns et al. . | |
| 4,863,395 | 9/1989 | Babuka et al. | 439/260 |
| 5,199,885 | 4/1993 | Korsunsky et al. | 439/79 |
| 5,203,725 | 4/1993 | Brunker et al. | 439/636 |

FOREIGN PATENT DOCUMENTS

| | | | |
|---|---|---|---|
| 132070 | 1/1985 | European Pat. Off. | H01R 23/70 |
| 519317 | 12/1992 | European Pat. Off. | H01R 23/70 |

OTHER PUBLICATIONS

IBM Technical Disclosure Bulletin, Pluggable Flex Circuit Connector With Sequence Features, Nov. 1990, vol. 33 No. 6B.

*Primary Examiner*—Gary F. Paumen
*Assistant Examiner*—Hien D. Vu
*Attorney, Agent, or Firm*—Jordan B. Bierman; Bierman and Muserlian

[57] ABSTRACT

This invention prevents lowering of working efficiency and an abnormal deformation, a breakage and the like of conductive terminals upon coupling a printed circuit base plate to a card edge connector in a card edge connector assembly. When a card edge connector 10 is inserted into an mouth 4 in a base plate holder 1, sliding edge portions 27 ride on ramp faces 5*a* on ribs 5 to pivot a pair of inner housings 20. Then, contacting portions 22*a* of first terminals 22 engage with second terminals on opposite sides of a printed circuit base plate 2. The printed circuit base plate 2 enters smoothly between the contacting portions 22*a* without causing an elastic deformation in the portions 22*a* and gouging the plate 22 due to their contact.

3 Claims, 5 Drawing Sheets

CARD EDGE CONNECTOR ASSEMBLY

BACKGROUND OF THE INVENTION

1. Field of the Invention

This invention relates to a card edge connector assembly in which a card edge connector is coupled to terminals on a printed circuit base plate.

2.Statement of the Prior Art

For convenience of explanation, a conventional card edge connector assembly will be described below by referring to drawings.

FIG. 5 is a longitudinal sectional view of a conventional card edge connector assembly, illustrating a midposition of coupling of the assembly. FIG. 6 is a longitudinal sectional view of the conventional card edge connector assembly, illustrating a finished position of coupling of the assembly.

A typical example of a conventional card edge connector assembly comprises a card edge connector a and a base plate holder g, as shown In FIGS. 5 and 6. A printed circuit base plate d is supported on a base plate holder d and is provided on opposite side edges with a plurality of exposed terminals. The card edge connector a is provided in a slit like Inlet c in a housing b with conductive terminals e having a plurality of resilient contacting portions f which face opposite to the terminals not shown on the printed circuit base plate when it is inserted into the inlet c.

Upon coupling the card edge connector a to the printed circuit base plate d of the base plate holder g, the printed circuit base plate d is inserted into the inlet c in the card edge connector a so that the plate d enters into a gap between the opposed contacting portions f of the terminal e. At this time, the contacting portions f are elastically deformed at their inclined parts by a distal end of the base plate d to widen the gap. Consequently, the terminals on the printed circuit base plate d are electrically connected to the conductive terminals e in the card edge connector a with the distal end of the plate d being clamped by the contacting portions f.

Since the printed circuit base plate d deforms forcibly the contacting portions d of the conductive terminals e against their elastic force In the card edge connector a, a large force is required to insert the plate d into the connector a. In addition, since a direction of elastically deforming the contacting portions f is substantially perpendicular to an entering direction of the printed circuit base plate d, the contacting portions f are abnormally deformed or broken if the plate d is forcibly inserted, as well as problems of gouging the plate and portions and lowering a working efficiency.

SUMMARY OF THE INVENTION

An object of the present invention is to provide a card edge connector assembly in which connection of a printed circuit base plate supported in a base plate holder and a card edge connector which holds conductive terminals to be contacted with the printed circuit base plate can be effected with a small force without lowering working efficiency or causing any abnormal deformation or breakage of the conductive terminals.

In order to achieve the above objects, a card edge connector assembly wherein a card edge connector having a plurality of first terminals is coupled to a base plate holder having a printed circuit plate which is provided at given positions on opposite sides with a plurality of second terminals adapted to contact with contacting portions of said first terminals, comprises: at least one inner housing for holding said first terminals to direct said contacting portions in a given direction; an outer housing provided with an inlet adapted to detachably received said printed circuit base plate and with an interior adapted to movably support said inner housing so that said contacting portions of said first terminals can contact with and be separated from said second terminals on said printed circuit base plate when said plate is inserted into said inlet; and means for moving said inner housing so that said contacting portions of said first terminals in said inner housing contact with said second terminals on said printed circuit base plate when said card edge connector is coupled to said base plate holder.

A pair of inner housings may be movably supported in said outer housing to move to and from said opposite sides of said printed circuit base plate.

The moving means includes ribs having a ramp face provided on upper and lower faces of an interior of said base plate holder and apertures formed in upper and lower walls of said outer housing and adapted to pass said ribs through said apertures so that said ramp faces on said ribs inwardly push said inner housing or housings in said outer housing when said outer housing is coupled to said base plate holder, whereby said contacting portions of said first terminals contact with said second terminals on said printed circuit base plate.

The inner housing or housings may be pivotably supported at their one ends in said outer housing.

Biasing means may be disposed between said inner housing or housings and said outer housing so that said contacting portions of said first terminals separate from said second terminals on said printed circuit plate.

In the card edge connector assembly of the present invention, when the printed circuit base plate is inserted into the inlet in the outer housing, the moving means moves the inner housing or housings to engage the contacting portions of the first terminals with the second terminals on the base plate. The moving means may move a pair of housings to clamp the printed circuit base plate, thereby contacting the contacting portions of the first terminals in the inner housings with the second terminals on the base plate. As the printed circuit base plate in the outer housing aproaches through the Inlet the inner housings, the ramp faces on the ribs In the base plate holder push inwardly the inner housings to engage the contacting portions of the first terminals with the second terminals on the base plate. Since the inner housings are pivoted about their one ends, the contacting portions of the first terminal moves on a circular arc path and in a direction substantially perpendicular to an inserting direction of the printed circuit base plate to contact with and separate from the second terminals. The biasing means act the inner housings to normally separate the contacting portions of the first terminals from the second terminals on the printed base plate.

According to the present invention, since the first terminals in the inner housing or housings can move away from the second terminals on the printed circuit base plate, it is possible to insert the printed circuit base plate by a small force and to avoid problems of lowering a working efficiency and occurrence of an abnormal deformation or breakage in the first terminals.

Since the inner housing or housings are forcibly pivoted by the ribs in the base plate holder, an engaging operation of the first and second terminals can be effected in connection with an inserting operation of the printed circuit base plate.

BRIEF DESCRIPTION OF THE DRAWINGS

FIG. 61 is a longitudinal sectional view of a finished position of coupling the assembly.

DETAILED DESCRIPTION OF THE PREFERRED EMBODIMENTS

Figure 1:
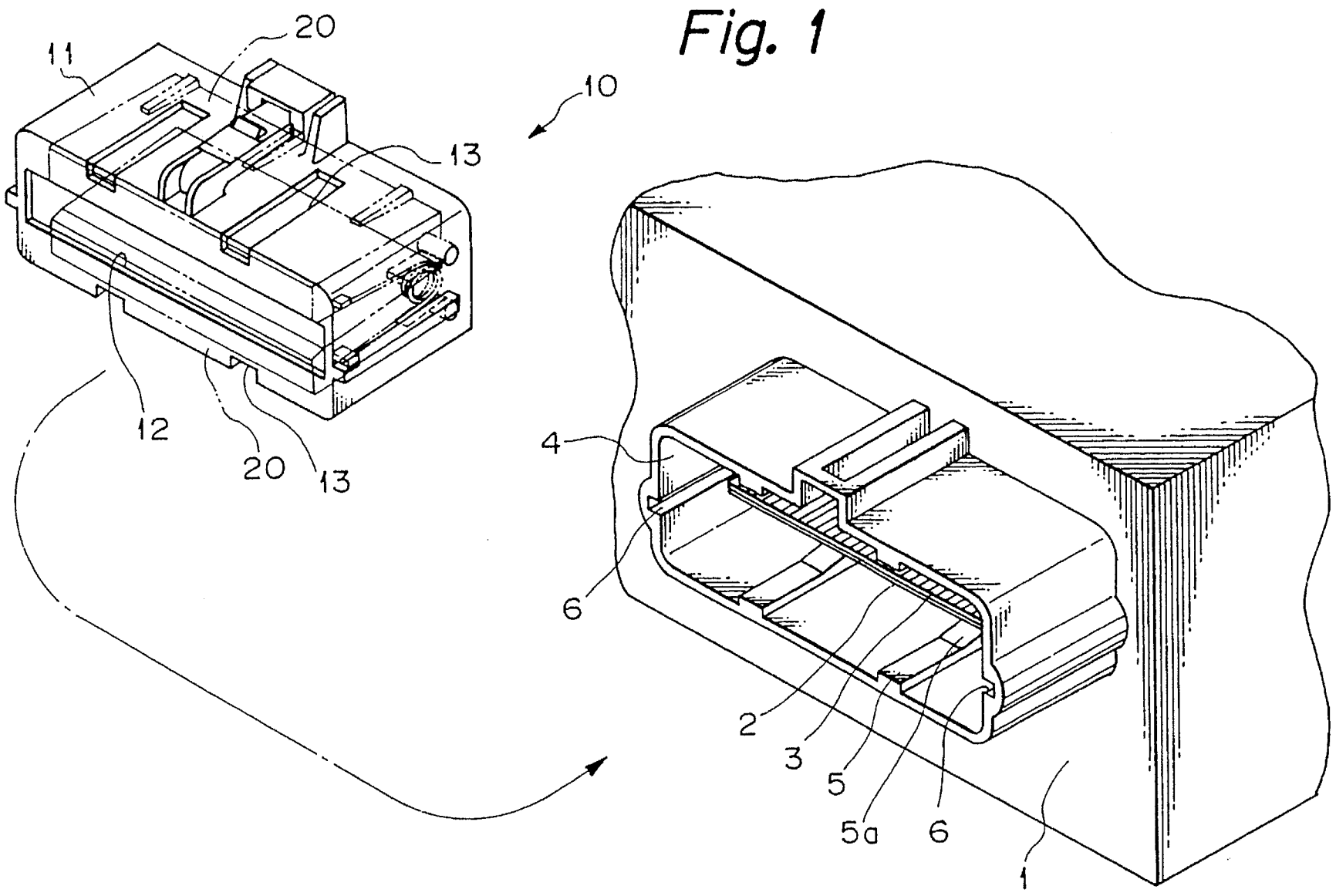
FIG. 1 is an exploded perspective view of a card edge connector assembly in accordance with the present invention.

An embodiment of a card edge connector assembly in accordance with the present invention will be explained below by referring now to FIGS. 1 through 4B.

The card edge connector assembly of the present invention comprises a card edge connector 10 and a base plate holder 1.

First, the base plate holder 1 will be explained below. A printed circuit base plate 2 is horizontally secured in the base plate holder 1. The printed circuit base plate 2 is provided at lateral edges on opposite sides with a plurality of terminals 3. The holder 1 is provided on its front end with a hood like coupling mouth 4 in which the base plate 2 is disposed to be spaced from the interior.

The mouth 4 is provided on upper and lower faces in the interior with a pair of ribs 5 extending to an inner part. Each rib 5 is provided at an inner end with a ramp face 5*a* which is gradually raised in a direction of approaching the base plate 2. Also, the coupling mouth 4 is provided in right and left faces in the interior with a guide groove 6 extending inwardly.

Figure 2:
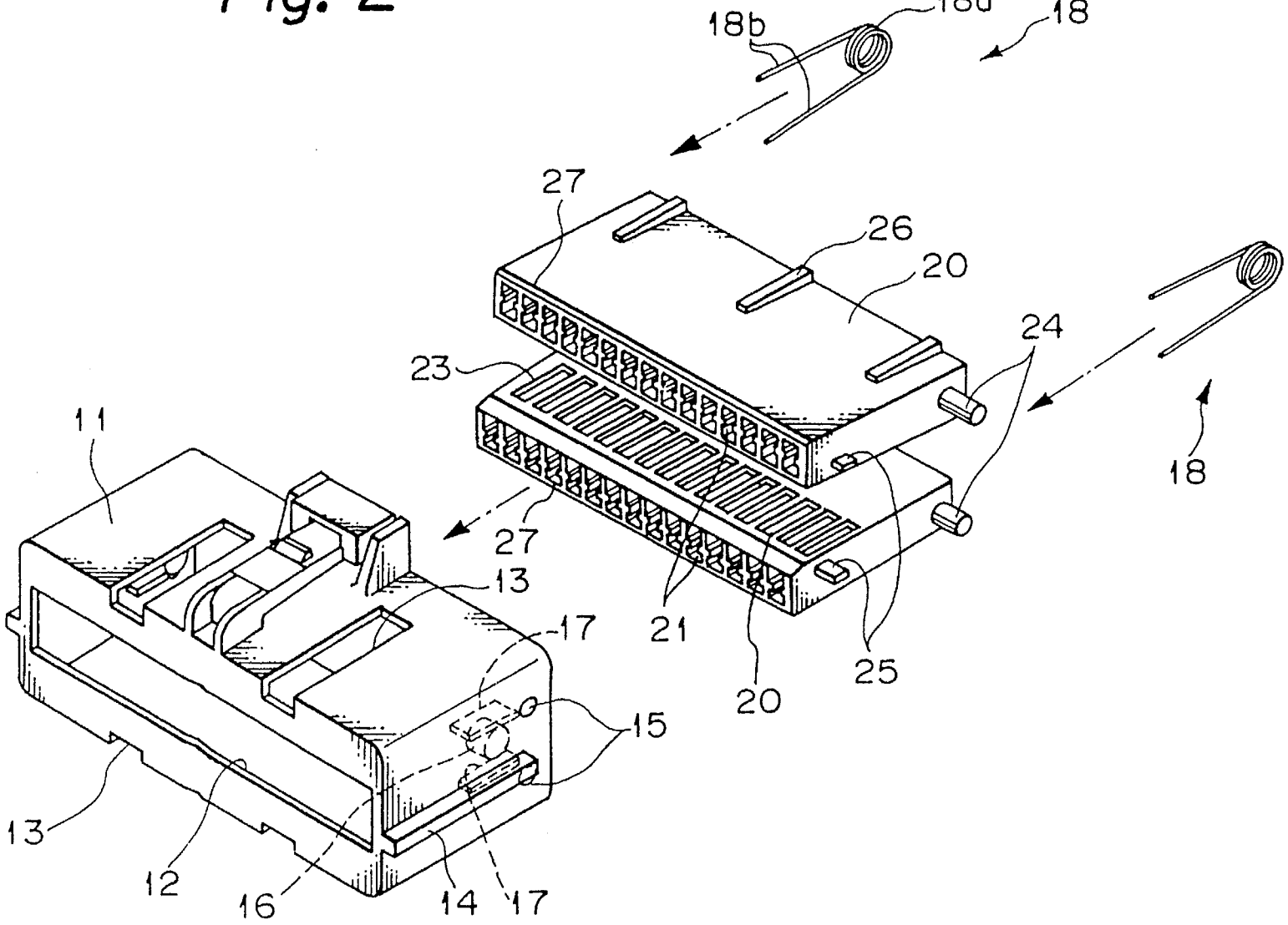
FIG. 2 is an exploded perspective view of a card edge connector of the present invention.

Next, the card edge connector 10 to be coupled to the base plate holder 1 will be explained. As best shown in FIG. 2, the card edge connector 10 includes an outer housing 11 and a pair of inner housings 20.

The outer housing 11 is formed into a shape and a size enough to be coupled in the mouth 4 of the base plate holder 1. The outer housing 11 is open at a rear end and is provided at a front end with a slit like inlet 12.

The outer housing 11 is provided in upper and lower walls with apertures 13 extending rearwardly from the front end and corresponding to the ribs 5 in the base plate holder 1. The outer housing 11 is also provided on right and left outer faces with guide ribs 14 extending rearwardly from the front end and corresponding to the guide grooves 6 in the base plate holder 1.

Figure 3:
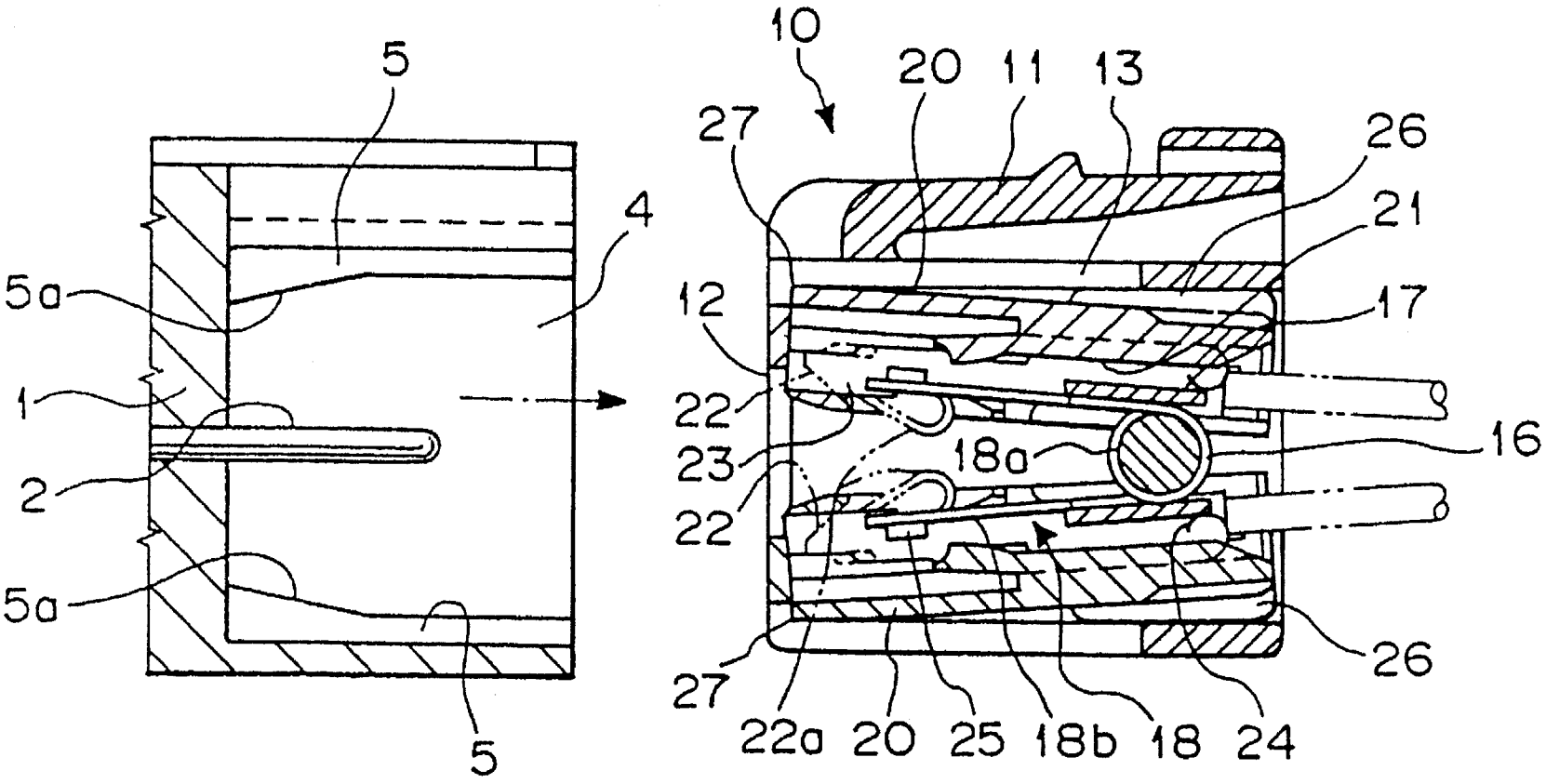
FIG. 3 is an exploded longitudinal sectional view of the card edge connector assembly.

The outer housing 11 is also provided at rear ends of the right and left walls with two pairs of bearing holes 15 adapted to receive bosses 24 of the inner housings 20. As best shown in FIG. 3, the outer housing 11 is provided on the right and left inner faces with spring-bearing bosses 16 and two pairs of spring stoppers 17 spaced forwardly from the bosses 16. The spring-bearing bosses 16 are opposed coaxially with each other. Torsion coil springs 18 (see FIG. 2) are disposed on the right and left inner faces of the outer housing 11 with a coil portion 18*a* of the spring 18 being fitted on the boss 16 and a pair of straight arms 18*b* being engaged with the stoppers Next, the inner housings 20 will be explained below. As best shown in FIG. 2, the pair of inner housings 20 are like thick plates. A plurality of elongate holes 21 are formed in each inner housing 20 so that each hole 21 extends from a front end to a rear end of the housing 20 and is Juxtaposed laterally in the housing 20. Each hole 21 accommodates each first conductive terminal 22 having an elastical deformable contacting portion 22*a* made of a bent thin metal plate. The contacting portions 22*a* of the first terminals 22 project through windows 23 formed in confronting walls of the respective inner housings 20 so that the contacting portions 22*a* are opposed to each other.

Each inner housing 20 is provided on the right and left outer faces at rear ends and front ends with the bosses 24 and projections 25. Upper inner housing 20 and lower inner housing 20 are provided on an upper outer face and an lower outer face with projections 26 which serve to cancel play between the outer and inner housings. Further, the upper and lower inner housings are provided on the upper and lower edges at the front ends with sliding edge portions 27 adapted to slide on the ribs 5 in the base plate holder 1.

The inner housings 20, in which the bosses 24 are rotatably inserted into the holes 15 and the projections 25 engage with the straight arms 18*b* of the torsion coil spring 18, is inserted in the outer housing 11. The inner housings 20 are biased by the torsion coil spring 18 so that the front ends of the housings are moved vertically in the outer housing 11. The projections 26 contact with the inner faces of the outer housings 11 normally (see FIG. 8).

An operation will be explained below which couples the card edge connector 10 to the printed circuit base plate 2 in the base plate holder 1.

The card edge connector 10 is inserted into the mouth 4 of the base plate holder 1 with the guide ribs 14 being fitted in the guide grooves 6. At this time, the distal end of the printed circuit base plate 2 is opposed to the inlet 12 of the card edge connector 10 and the ribs 5 in the mouth 4 are fitted in the aperture 13 in the connector 10.

Figure 4A:
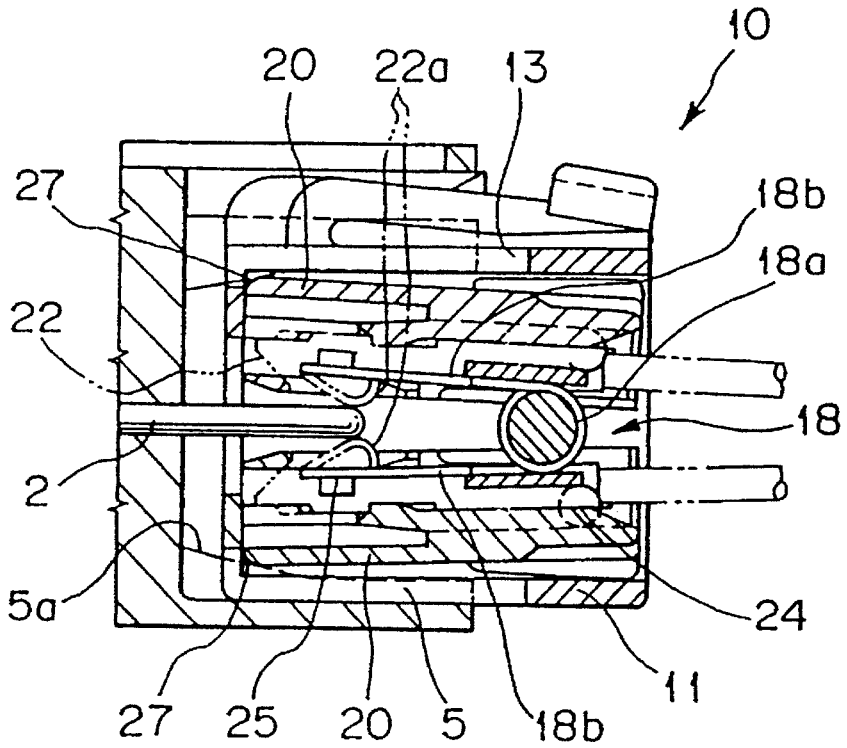
FIG. 4A is a longitudinal sectional view of the assembly, illustrating a midposition of coupling the assembly.
Figure 4B:
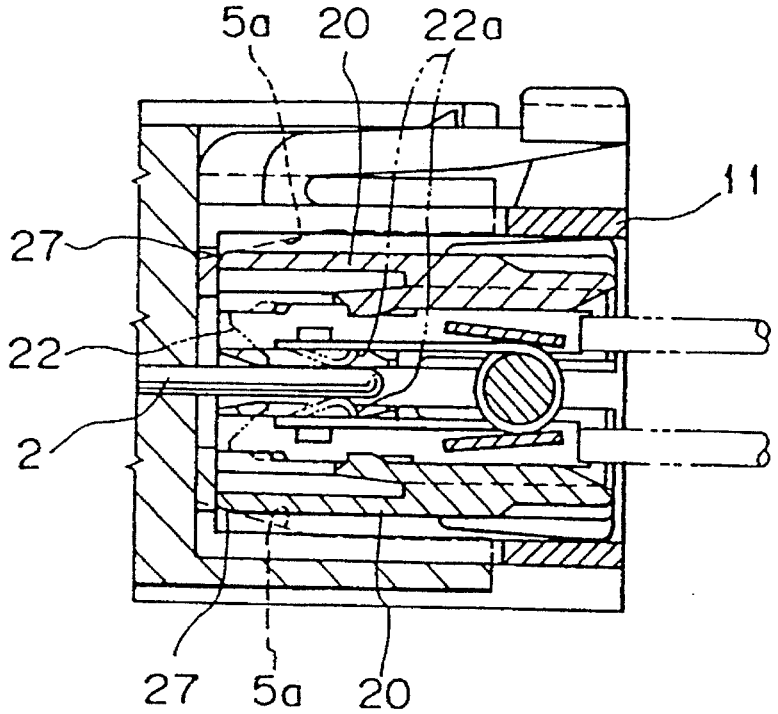
FIG. 4B is a longitudinal sectional view of the assembly, illustrating a finished position of coupling the assembly.
Figure 5:
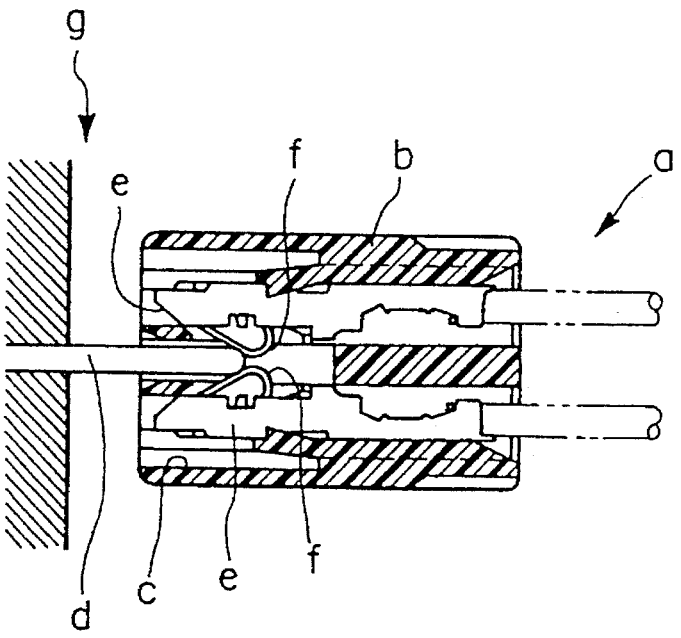
Fig. 5 PRIOR ART
FIG. 5 is a longitudinal sectional view of a conventional card edge connector assembly, illustrating a midposition of coupling the assembly.
Figure 6:
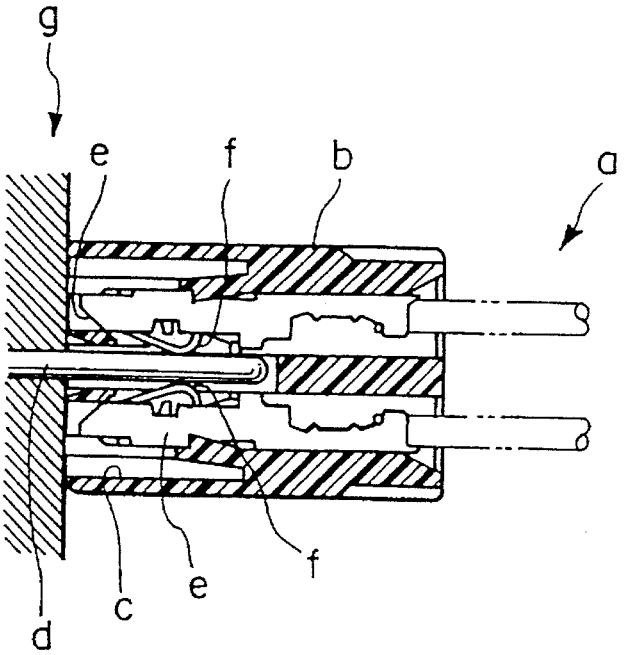
Fig. 6 PRIOR ART

As shown in FIG. 4A, when the card edge connector 10 is advanced as it is, the contacting portions 22*a* of the first terminals 22 in the card edge connector 10 contact with the edges of the opposite sides of the printed circuit base plate 2 while the front sliding edge portions 27 of the inner housings 20 ride on the ramp faces 5*a* of the ribs 5.

When the card edge connector 10 is further advanced, the sliding edge portions 27 slide on the ramp 5*a* of the ribs 5 and both inner housings 20 are pivoted inwardly about the bosses 24 against the biasing force of the torsion coil spring 18 so that free ends of the housings 20 clamp the printed circuit base plate 2. Then, the contacting portions 22*a* of the first terminals 22 are pressed on the second terminals 3 on the opposite sides of the printed circuit base plate 2 while the portions 22*a* are slightly elastically deformed. The coupling is complete at the final position shown In FIG. 4B.

In the operation of coupling the card edge connector 10 to the base plate holder 1, the elastic deformation of the contacting portions 22*a* of the first terminals 22 is caused not by a pressure force due to insertion of the printed circuit base plate 2 but by a pressure force due to rotation of the inner housings 20. This rotation causes the contacting portions 22 to be contacted with the printed circuit base plate 2 in the vertical direction. Accordingly, gouging due to contact of the printed circuit base plate 2 and the first terminals 22 or abnormal deformation or breakage of the contacting portions 22*a* will not occur during a coupling operation.

It should be noted that the present invention is not limited to the above embodiment and may be altered to, for example, the following forms:

(a) Although a pair of upper and lower inner housings 20 are provided in the above embodiment, either upper or lower inner housing 20 may be provided in association with either upper or lower side of the printed circuit base plate;

(b) Although the inner housings 20 are pivoted about the bosses 24 in the above embodiment, the housings may be moved in parallel relative to the printed circuit base plate;

(c) Although the torsion coil spring 18 is used to bias the inner housings 20 in the above embodiment, the spring may be another spring such as a leaf spring or a compression coil spring;

(d) Although the sliding edge portions 27 of the inner housings 20 slide on the ramp face 5*a* of the ribs 5 in the base plate holder 1 and thus the inserting operation of the card edge connector 10 is carried out in connection with the contacting operation of the first and second terminals 22 and 8 in the above embodiment, the contacting operation may be carried out after the inserting operation.

The present invention should not be limited to the embodiment described above and illustrated in the accompanied drawings and can be altered to any various forms without departing from the spirit of the present invention.

What is claimed is:

1. A card edge connector assembly wherein a card edge connector having a plurality of first terminals is coupled to a base plate holder having a printed circuit plate including a plurality of second terminals adapted to contact with contacting portions of said first terminals, said card edge connector assembly further comprising:

at least one movable inner housing for holding said first terminals to guide said contacting portions in a direction;

an outer housing provided with an inlet to receive said printed circuit plate and with an interior to support said movable inner housing so that said contacting portion of said first terminals can contact said second terminals when said card edge connector inserted into said base plate holder, and separate from said second terminals when said card edge connector is withdrawn from said base plate holder;

at least one rib having a ramp face on at least one of upper and lower faces of an interior wall of said base plate holder, and a corresponding aperture in said outer housing, whereby said rib is adapted to pass through said aperture to push said inner housing toward said second terminals when said card edge connector is inserted into said base plate holder, whereby said contacting portions of said first terminals contact said second terminals.

2. The assembly of claim 1 wherein said bias is a coil spring having its coil around said common axis.

3. The assembly of claim 1 wherein said outer housing has an upper inner housing and a lower inner housing which are pivotable with respect to each other about a common axis.

* * * * *